US008579044B2

(12) United States Patent
Allen et al.

(10) Patent No.: US 8,579,044 B2
(45) Date of Patent: Nov. 12, 2013

(54) BENDING OF A SHAFT OF A STEERABLE BOREHOLE DRILLING TOOL

(75) Inventors: Peter Allen, Ulverston (GB); Nigel John Dennis Kilshaw, Kendal (GB); Walter Edward Somerville Davey, Histon (GB); Jonathan Charles Long, Ulverston (GB); Donald Ian Carruthers, Kirkby in Furness (GB)

(73) Assignee: Gyrodata, Incorporated, Houston, TX (US)

( * ) Notice: Subject to any disclaimer, the term of this patent is extended or adjusted under 35 U.S.C. 154(b) by 327 days.

(21) Appl. No.: 13/071,402

(22) Filed: Mar. 24, 2011

(65) Prior Publication Data

US 2011/0240368 A1 Oct. 6, 2011

Related U.S. Application Data

(60) Provisional application No. 61/319,093, filed on Mar. 30, 2010.

(51) Int. Cl.
*E21B 7/04* (2006.01)

(52) U.S. Cl.
USPC ..... 175/26; 175/73

(58) Field of Classification Search
USPC ..... 175/26, 45, 61, 73
See application file for complete search history.

(56) References Cited

U.S. PATENT DOCUMENTS

| | | | | |
|---|---|---|---|---|
| 3,326,008 | A | 6/1967 | Baran et al. | |
| 7,188,685 | B2 | 3/2007 | Downton et al. | |
| 2006/0266555 | A1* | 11/2006 | Chen et al. | 175/61 |
| 2007/0251729 | A1* | 11/2007 | Sand et al. | 175/107 |

FOREIGN PATENT DOCUMENTS

| | | | |
|---|---|---|---|
| EP | 02 201 398 | A1 | 12/1986 |
| GB | 2 172 325 | A | 9/1986 |
| GB | 2 172 324 | B | 7/1988 |
| GB | 2 172 325 | B | 7/1988 |
| GB | 2 177 738 | B | 8/1988 |
| WO | WO 02/46567 | A1 | 6/2002 |
| WO | WO 02/46568 | A1 | 6/2002 |
| WO | WO 2007/110502 | A1 | 10/2007 |

OTHER PUBLICATIONS

Sigurd Kinn, et al, "Use of a Rotary Steerable Tool at the Valhall Field, Norway", 2000 IADC/SPE Drilling Conference, New Orleans, Louisiana, Feb. 23-25, 2000 in 10 pages.
International Search Report and Written Opinion dated Nov. 20, 2012 in PCT/US2011/029865, filed Mar. 24, 2011.

* cited by examiner

*Primary Examiner* — William P Neuder
(74) *Attorney, Agent, or Firm* — Knobbe, Martens, Olson & Bear LLP

(57) ABSTRACT

In certain embodiments, a steerable drilling tool is provided including a rotatable shaft extending through a housing where the shaft and the housing are separated by at least one bearing or two sets of bearings, the shaft having a first portion terminating at a first end of the shaft and a second portion terminating at a second end of the shaft. The steerable drilling tool may further include a drill bit structure operatively coupled to the first portion and a steering subsystem comprising a pair of bearings operatively coupled to the first portion. The steering subsystem may be configured to angulate the shaft by exerting force substantially through the pair of bearings. In certain embodiments, the first portion is between the first end and about one-third of the length of the shaft from the first end towards the second end.

26 Claims, 8 Drawing Sheets

BENDING OF A SHAFT OF A STEERABLE BOREHOLE DRILLING TOOL

CROSS-REFERENCE TO RELATED APPLICATIONS

This application claims the benefit of priority under 35 U.S.C. §119(e) of U.S. Provisional Patent Application No. 61/319,093, filed on Mar. 30, 2010, and entitled "Bending of a Shaft of a Steerable Borehole Drilling Tool," the disclosure of which is hereby incorporated by reference in its entirety.

FIELD OF THE DISCLOSURE

The present application relates generally to the drilling of boreholes or wellbores, and more particularly, to steerable drilling tools such as those for oil field and gas field exploration and development.

BACKGROUND OF THE DISCLOSURE

Directional drilling for the exploration and development of oil and gas fields advantageously provides the capability of generating boreholes which deviate significantly relative to the vertical direction (that is, perpendicular to the Earth's surface) by various angles and extents but generally follow predetermined profiles. In certain circumstances, directional drilling is used to provide a borehole which avoids faults or other subterranean structures (e.g., salt dome structures). Directional drilling is also used to extend the yield of previously-drilled wells by milling through the side of the previously-drilled well and reentering the formation, and drilling a new borehole directed so as to follow the hydrocarbon-producing formation. Directional drilling can also be used to provide numerous boreholes beginning from a common region, each with a shallow vertical portion, an angled portion extending away from the common region, and a termination portion which can be vertical. This use of directional drilling is especially useful for offshore drilling, where the boreholes are drilled from the common region of a centrally positioned drilling platform.

Directional drilling is also used in the context of substantially horizontal directional drilling ("HDD") in which a pathway is drilled for utility lines for water, electricity, gas, telephone, and cable conduits. Exemplary HDD systems are described by Alft et al. in U.S. Pat. Nos. 6,315,062 and 6,484,818. HDD is also used in oilfield and gasfield exploration and development drilling.

A rotary steerable drilling tool is a type of directional drilling tool which allows for directional drilling of boreholes while allowing or maintaining rotation of the drill string. This technique can provide improved directional control, improved hole cleaning, improved borehole quality and generally minimizes drilling problems as compared to earlier technologies. Such tools include steering mechanisms enabling controlled changes in borehole direction. One type of steering mechanism involves expandable ribs or pads located around the drilling tool which can be actuated to apply a force on the borehole walls so as to direct the drilling tool in a desired direction. However, in part because they rely on contact with the borehole surface, such steering mechanisms can have certain disadvantages.

SUMMARY

According to certain aspects, a steerable drilling tool is provided comprising a rotatable shaft extending through a housing where the shaft and the housing are separated by at least one bearing. The shaft can have a first portion terminating at a first end of the shaft and a second portion terminating at a second end of the shaft. The tool may further include a drill bit structure operatively coupled to the first portion. In some embodiments the tool also includes a steering subsystem comprising a pair of bearings operatively coupled to the first portion. The steering subsystem can be configured to angulate the shaft by exerting force substantially through the pair of bearings. In certain instances, the first portion is between the first end and about one-third of the length of the shaft from the first end towards the second end.

According to some embodiments, a steerable drilling tool is provided comprising a housing and a rotating shaft having a first portion terminating at a first end of the shaft and a second portion terminating at a second end of the shaft. The tool can further include a drill bit structure operatively coupled to the first portion. In some embodiments, the tool includes a steering subsystem disposed between the housing and the shaft. The steering subsystem according to some embodiments comprises an angulation assembly operatively coupled to the first portion and to the shaft. The steering subsystem can further comprise a pivot member mechanically coupled to the angulation assembly. The angulation assembly can be configured to pivot in a plane substantially parallel to the shaft about the pivot member, for example.

In certain embodiments, a method is provided for steering a drilling tool while drilling a borehole. The method can include providing a steerable drilling tool, where the drilling tool comprises a rotatable shaft having a first portion terminating at a first end of the shaft and a second portion terminating at a second end of the shaft. The tool may also include a drill bit structure operatively coupled to the first portion and, in some embodiments, includes a steering subsystem configured to angulate the shaft by exerting a bending moment substantially entirely on the first portion. The first portion can be between the first end and one-third of the length of the shaft from the first end towards the second end, for example. The method further includes receiving a command to angulate the shaft so as to direct the drilling tool from a current course to a target course. In some embodiments, the method also includes actuating the steering subsystem in response to the command so as to exert the bending moment and angulate the shaft.

According to yet other aspects, a steerable drilling tool is provided including a rotating shaft having a first portion terminating at a first end of the shaft and a second portion terminating at a second end of the shaft. The tool can also include a drill bit structure operatively coupled to the first portion. The tool in certain embodiments further includes a steering subsystem configured to angulate the shaft by exerting first and second forces on the shaft at first and second locations on the shaft which are spaced apart from one another by a distance of from between about the diameter of the rotating shaft to about eight times the diameter of the rotating shaft, the first and second forces exerted substantially perpendicular to the shaft and in substantially opposite directions.

DETAILED DESCRIPTION

Certain embodiments described herein provide a steerable drilling tool having a steering mechanism enabling controlled changes in drilling direction and providing enhanced operational efficiency, among other advantages. Example directional drilling systems and associated techniques are described in U.K. Pat. Nos. 2172324, 2172325, 2177378 issued to Douglas, et al., and a publication entitled *Use of a Rotary Steerable Tool at the Valhall Field, Norway*, written by Sigurd Kinn, SPE, BP Norway AS and Peter Allen, SPE, Cambridge Drilling Automation Ltd and Martin Slater, SPE, BP Amoco Norway AS (IADC/SPE 59217) each of which is hereby incorporated in its entirety by reference herein.

Figure 1:
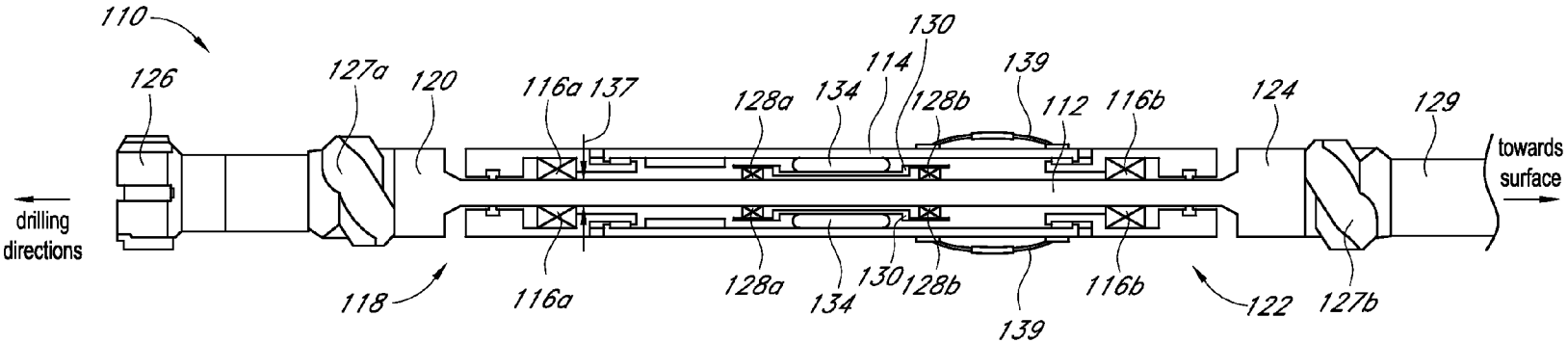
FIG. 1 is a cut-away schematic diagram of an example steerable drilling tool having a bridge-type steering mechanism.
Figure 3:
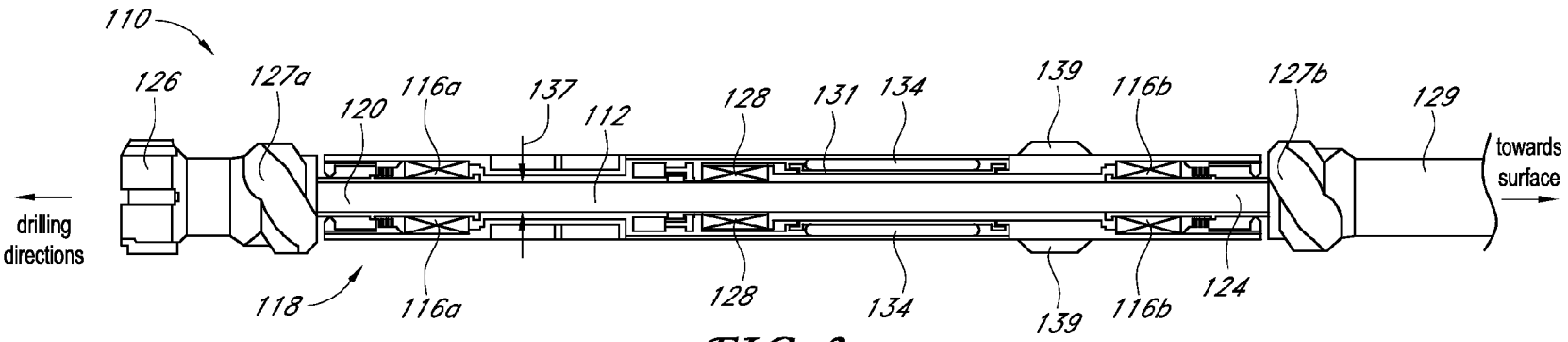
FIG. 3 is a cut-away schematic diagram of another example steerable drilling tool having a cantilever-type steering mechanism.
Figure 4:
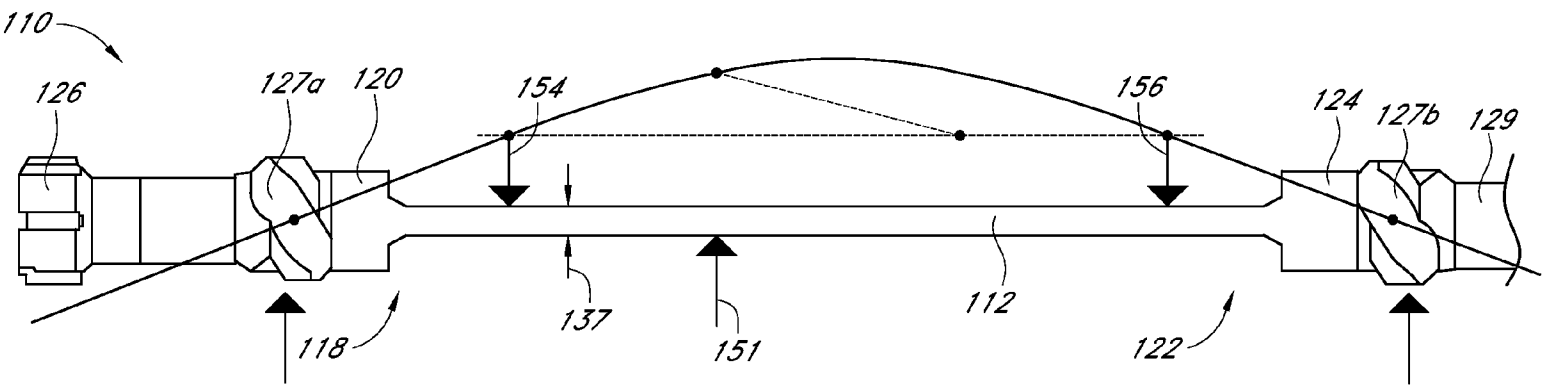
FIG. 4 is a cut-away schematic diagram illustrating certain forces incident on portions of the steerable drilling tool of FIG. 3 during a steering operation.

FIG. 1 schematically illustrates an example steerable drilling tool 110 having a bridge-type steering mechanism. The drilling tool 110 includes a rotating shaft 112 passing through a nominally non-rotating housing 114, where the shaft 112 and housing 114 are separated by two rotating main bearings 116*a*, 116*b*. The shaft 112 has first portion 118 terminating at a first end 120 of the shaft 112 and a second portion 122 terminating at a second end 124 of the shaft 112. A drill bit structure 126 is operatively coupled to the first portion 118 through a first stabilizer 127*a*. The drilling tool 110 may form part of a drill string extending to the surface. For example, the tool 110 may include a second stabilizer 127*b*, and the remainder of the drill string can include one or more pipe segments 129 coupled to the drilling tool 110 via the second stabilizer 127*b*. The drilling tool 110 comprises a steering mechanism having a bridge arrangement including two sets of rotating bridge bearings 128*a*, 128*b* coupled to one or more actuators 134 (e.g., pressurized, hydraulic actuators) via a bridge structure 130. In one configuration, there are four actuators 134 disposed about the circumference of the shaft 112. The tool also includes at least one anti-rotation device 139 configured to inhibit rotation of the nominally non-rotating components of the drilling tool 110 (e.g., the housing 114) with respect to the borehole. For example, as shown, the anti-rotation device 139 can include a plurality of springs configured to contact the inner surface of the borehole during use. In other configurations, the anti-rotation device 139 can include a plurality of spring boxes, as shown in FIGS. 3 and 4 below.

While shown as a cut-away diagram, the drilling tool 110 and certain components thereof (e.g., the drill bit structure 126, bearings 116*a*, 116*b*, bridge bearings 128*a*, 128*b*, housing 114, shaft 112) are generally cylindrical.

Each of the sets of rotating bearings 116*a*, 116*b*, 128*a*, 128*b* generally form an annular cylinder having an interior surface which rotates with respect to an outer surface. For example, the main bearings 116*a*, 116*b* have an interior surface in contact with a sleeve (not shown) encasing the rotating shaft 112 or a portion thereof and positioned between the bearings 116*a*, 116*b* and, and an exterior surface in contact with the inner surface of the housing 114. Similarly, the sets of bridge bearings 128*a*, 128*b*, have an interior surface in contact with the sleeve (not shown), and an exterior surface in contact with the bridge structure 130. As such, the bearings 116*a*, 116*b*, 128*a*, 128*b* allow coupling of the rotating shaft 112 to non-rotating portions of the tool, such as the housing and steering mechanism.

Figure 2:
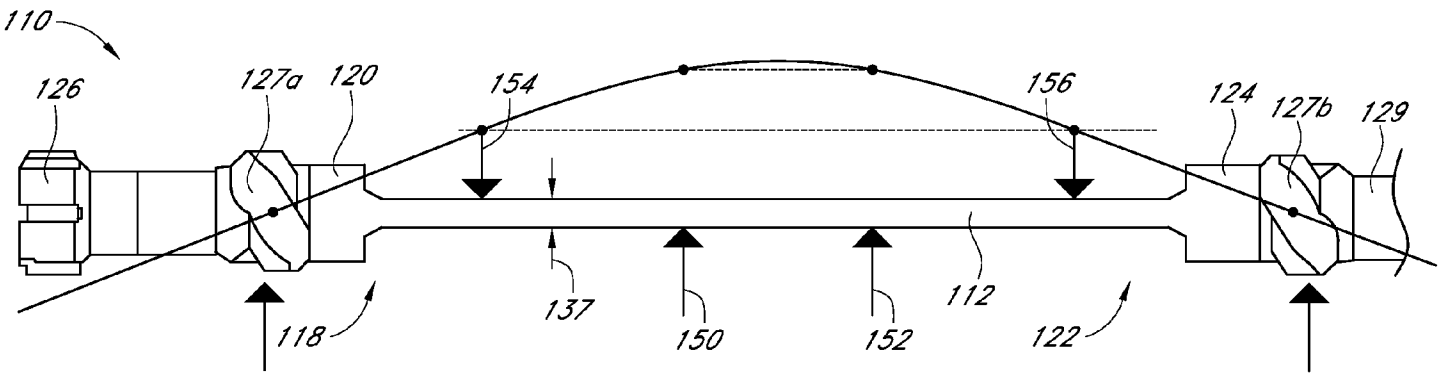
FIG. 2 is a cut-away schematic diagram illustrating certain forces incident on portions of the steerable drilling tool of FIG. 1 during a steering operation.

As shown in FIG. 2, upon selective actuation (e.g., expansion) of one or more of the actuators 134, the bridge bearings 128*a*, 128*b* apply actuation forces 150, 152 at two locations on the shaft 112. The actuation forces 150, 152, are reacted via forces 154, 156 at the main bearings 116*a*, 116*b* on either end of the shaft 112, resulting in shaft angulation. For example, actuation of one or more of the actuators 134 (e.g., the actuator 134 at the bottom of FIG. 1) results in actuation forces 150, 152 on the bridge structure 130 and the shaft 112 (e.g., at the bottom of FIG. 2 in an upward direction) and reaction forces 154, 156 on the shaft 112 at the main bearings 116*a*, 116*b* (e.g., in a downward direction in FIG. 2). In such a scenario, the shaft 112 angulates such that the drill bit structure 126 is steered (e.g., in a generally downward direction as shown in FIG. 2) during drilling.

During steering, the relative angulation between the deflected shaft 112 and the housing 114 is accommodated in certain embodiments (e.g., by an angulation joint adjacent to each of the bearings 116*a* and 116*b* or using bearings 116*a*, 116*b* of a type which allow angulation). FIG. 1 shows an arrangement with angulation joints.

FIG. 3 schematically illustrates another example steerable drilling tool 110. As shown, the drilling tool 110 is generally similar to the drilling tool 110 of FIG. 1, but includes a cantilever-type steering mechanism instead of a bridge-type steering mechanism. Referring to FIG. 3 and to FIG. 4, the cantilever-type steering mechanism includes one or more actuators 134 (e.g., four pressurized hydraulic actuators) and a single cantilever bearing 128 instead of the two bridge bearings of FIGS. 1 and 2. The actuators 134 can selectively actuate to apply an actuation force 151 at only one point on the shaft 112, through the bearing 128, and resulting in reaction forces 154, 156 at the main bearings 116*a*, 116*b*. The cantilever mechanism of FIGS. 3 and 4 is unlike the bridge mechanism of FIGS. 1 and 2, which applies actuation forces 150, 152 at two locations along the shaft 112. The drilling tool 110 configuration of FIGS. 3 and 4 can be relatively less costly and/or simpler to manufacture than the configuration of FIGS. 1 and 2, in part because it includes one less bearing assembly.

As discussed, the steering mechanisms of the drilling tool 110 of FIGS. 1 and 2 applies forces 150, 152, 154, 156 to the shaft 112 at locations which are generally distributed along the length of the shaft 112. Similarly, the drilling tool 110 of FIGS. 3 and 4 applies forces 151, 154, 156 to the shaft 112 at locations which are generally distributed along the length of the shaft 112. As a result, shaft angulation is effected by these tools 110 generally along the length of the shaft 112. However, in general, shaft angulation near the point of drilling most directly translates into directional changes during drilling. Thus, it can be advantageous to apply the steering forces primarily near the point of drilling (e.g., relatively near the drill bit 126) rather than along the length of the shaft 112. The bearings 116*a* and 116*b* shown in the example configuration of FIG. 3 are of the angulating type and in this case an angulation joint is not used.

Figure 5:
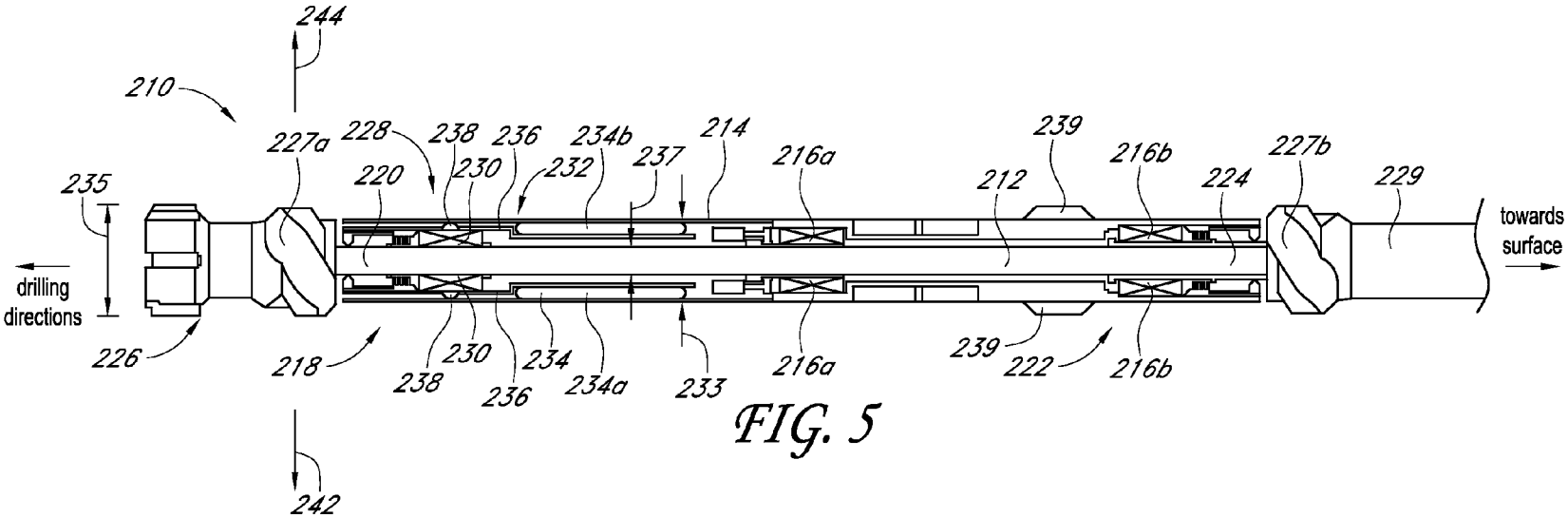
FIG. 5 is a cut-away schematic diagram illustrating an example steerable drilling tool for use in a borehole in accordance with certain embodiments described herein.

FIG. 5 schematically illustrates an example steerable drilling tool 210 for use in a borehole in accordance with certain embodiments described herein. The steerable drilling tool 210 comprises a rotatable shaft 212 extending through a housing 214. The shaft 212 and the housing 214 of certain embodiments are separated by at least one bearing, which in the example of FIG. 5 comprises sets of bearings 216*a*, 216*b*. In certain embodiments, the shaft 212 has a first portion 218 terminating at a first end 220 of the shaft 212 and a second portion 222 terminating at a second end 224 of the shaft 212. The steerable drilling tool 210 of certain embodiments further comprises a drill bit structure 226 that can be operatively coupled to the first portion 218. In certain embodiments, the steerable drilling tool 210 further comprises a steering subsystem 228 comprising a pair of bearings 230 operatively coupled to the first portion 218. The steering subsystem 228 can be configured to angulate the shaft 212 by exerting force substantially through the pair of bearings 230. The pair of bearings 230 may also be positioned to separate the shaft 212 from the housing 214, in a manner similar to the sets of bearings 216*a*, 216*b*. In certain embodiments, the first portion 218 is between the first end 220 and about one-third of the length of the shaft 212 from the first end 220 towards the second end 224. The bearings 216*a*, 216*b* of the example tool 210 shown in FIG. 5 are of the angulating type, are thus configured to allow angulation of the shaft 212. In other embodiments, separate angulation joints can be used in a manner similar to the example shown in FIG. 1.

While shown in FIG. 5 as a side view cut-away diagram, it will be appreciated that the tool 210 and certain components thereof (e.g., the drill bit structure 226, housing 214, shaft 212, plurality of bearings 216*a*, 216*b*, the pivot member 238 described below, and each of the pair of bearings 230) are generally cylindrical.

The tool diameter 233 generally corresponds to the diameter of a majority of the tool 210 (e.g., in the illustrated embodiment, the tool diameter 233 corresponds to the diameter of the housing 214). In some cases, the tool diameter 233 corresponds to the diameter of one or more of the first and second stabilizers 227*a*, 227*b* and/or the diameter of some other portion of the tool instead of, or in addition to, the diameter of the housing 214. In one embodiment, the tool 210 has a diameter 233 of about 4¾ inches, although other diameters 233 are possible, such as diameters 233 of less than about 4¾ inches or greater than about 4¾ inches (e.g., about 7 inches or about 10 inches).

The wellbore has a diameter 235 that may generally depend on the diameter of the drill bit, and can range from about 150 millimeters to about 450 millimeters, depending on the specific drilling tool 110 configuration. Additionally, in one embodiment, the rotating shaft 212 of the tool 210 has a diameter 237 of about 62 millimeters (i.e., about 2.4 inches). In another embodiment, the diameter 237 is about 60 millimeters. Other shaft diameters 237 are possible, such as, for example, shaft diameters 237 of less than about 62 millimeters, less than about 60 millimeters, greater than about 62 millimeters, or greater than about 60 millimeters. In various configurations, the shaft diameter 237 may range from about 40 millimeters to about 80 millimeters. For example, the shaft diameter 237 may be about 40, 50, 60, 70, or 80 millimeters.

Generally, the design parameters of the shaft 212 (e.g., the diameter 237 and/or length) may be selected based on a variety of factors including the torque the shaft 212 is expected to undergo, weight on bit, stresses induced on the shaft during bending (e.g., during steering), dynamic loading considerations, the strength of the selected shaft 212 material, tool 210 geometry, the strength of the other components of the tool, and the like. Moreover, the shaft diameter 237, length, selected material, and the like may be chosen such that the shaft 212 bends elastically by a sufficient amount to enable effective steering, allowing the tool 212 to achieve a sufficient turn rate and turn magnitude. In one example configuration, the diameter 233 of the tool 212 is about 4¾ inches and the shaft diameter 237 is about 60 millimeters.

A variety of other values for the tool 210 diameter 233, the wellbore diameter 235, and the shaft diameter 237 are possible. For example, in some implementations, such as where the tool diameter 233 is about 10 inches, the rotating shaft 212 has a diameter 237 of about 135 millimeters. For example, the diameter 237 of the shaft 212 in such cases may range from about 100 millimeters to about 150 millimeters (e.g., about 100, 105, 110, 120, 125, 130, 135, 140, 145, or 150 millimeters). Moreover, in certain such cases, the diameter 235 of the wellbore ranges from about 12¼ inches to about 18 inches.

In yet other embodiments, the shaft 212 has a diameter 237 ranging from between about 70 millimeters to about 110 millimeters, such as where tool 210 has a diameter 233 of about 7 inches. For example, the shaft 212 diameters 237 in two such example configurations are 85 millimeters and 90 millimeters, respectively.

Figure 6:
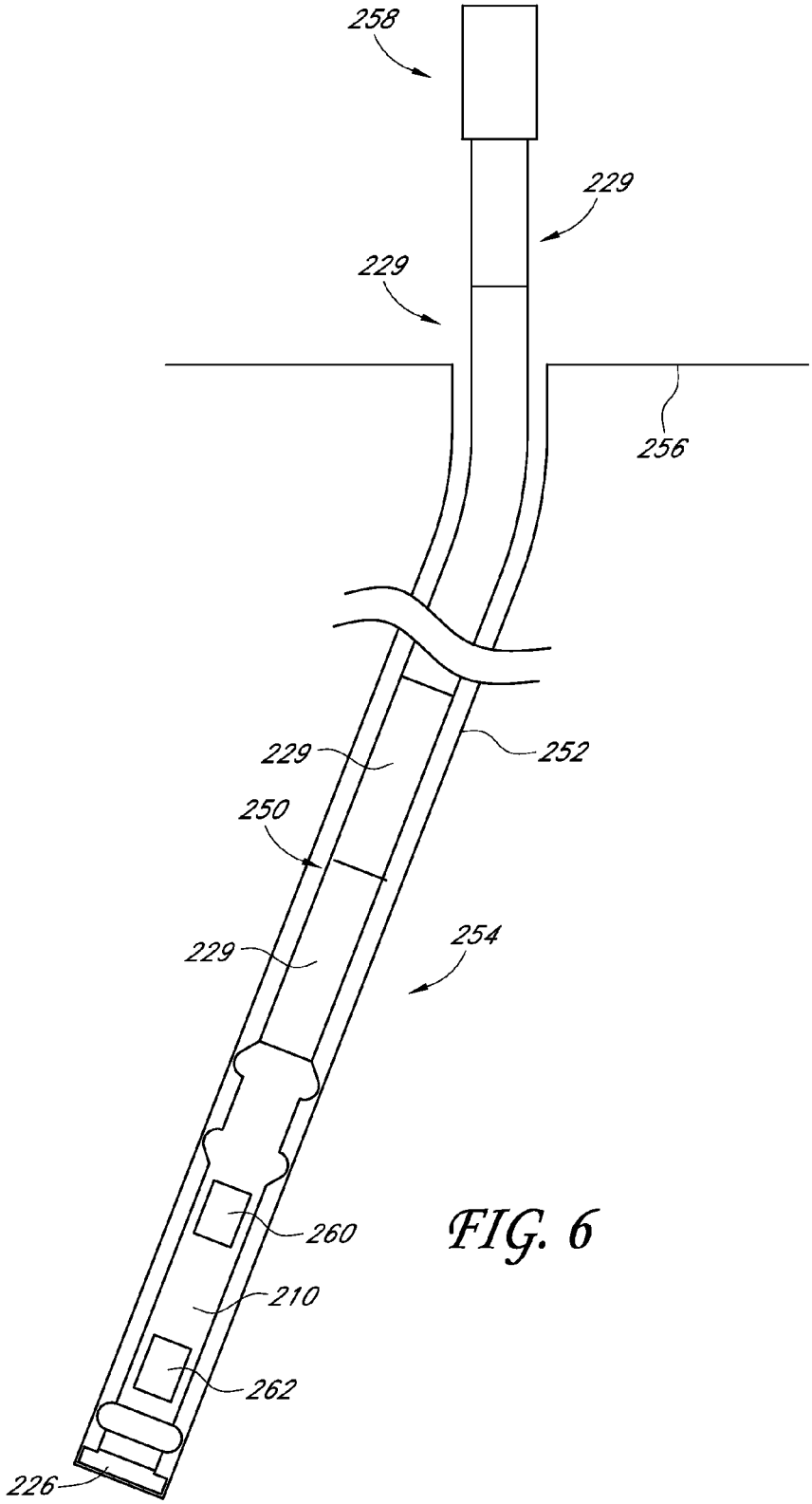
FIG. 6 schematically illustrates an example drill string for use in a borehole and including a drilling tool in accordance with certain embodiments described herein.

The steerable drilling tool 210 may be a rotary steerable drilling tool, for example, and can form a part of a downhole portion of a drill string extending to the Earth's surface. In certain embodiments, for example, the remainder of the drill string includes the one or more pipe segments 229, which extend to the Earth's surface in a daisy-chained configuration. FIG. 6 schematically illustrates a drilling tool 210 forming a part of an example drill string 250 for use in a borehole 252. The example drill string 250 includes a downhole portion 254 including the drilling tool 210 and one or more pipe segments 229 extending to the surface 256.

The shaft 212 in certain embodiments comprises an annular, metal cylinder. Although other materials can be used, the shaft 212 is formed of ductile, non-magnetic, corrosion resistant, high strength steel in one instance. The shaft 212 can further be adapted to conduct drilling fluid along the length of the shaft 212 from the second end 222 to the first end 218, for eventual delivery to the borehole 252 through the drill bit structure 226. Additionally, in some cases, a sleeve (not shown) encases the shaft or a portion thereof.

The non-rotating housing 214 contains various components of the steerable drilling tool 210, such as various sensors and/or electronics (not shown), batteries to provide electrical power, hydraulics (e.g., pumps, control valves, the actuators 234), bearings (e.g., the bearings 216*a*, 216*b*, the pair of bearings 230), the pivot member 238, the rotatable shaft 212, and the like. The housing in some embodiments comprises an annular, metal (e.g., ductile, non-magnetic, corrosion resistant, high strength steel) cylinder.

The drill bit structure 226 of certain embodiments comprise a plurality of cutting or crushing elements, and can be configured to rotate during drilling so as to drill through the Earth and extend the borehole 252. Drill bit structures 226 compatible with embodiments described herein can be fixed cutter or roller cone style drill bits, for example. In certain embodiments, the drill bit structure 226 or portions thereof are constructed from various high strength materials. For example, the cutting or crushing structure can be made from Polycrystalline Diamond Compact (PDC), tungsten carbide, or high strength steel in certain cases, among other types of materials. The body of the drill bit structure 226 can be made from tungsten carbide matrix or high strength steel, for example. In certain embodiments, the drill string 250 is adapted to conduct drilling fluid (e.g., drilling mud) from the surface for eventual delivery into the borehole 252. For example, as will be appreciated, drilling fluid can be delivered to the drill string 250 from the surface 256 using a pump or other mechanism, and can then be transmitted through the drill pipe segments 229 and the drilling tool 210 before eventual delivery to the borehole 252 through the drill bit structure 226. Moreover, in certain cases, the housing 214 and/or other portions of the tool 210 may be filled with oil that is compensated to ambient pressure.

Referring again to FIG. 5, each set of bearings 230, 216*a*, 216*b* can generally form an annular cylinder having an outer surface and an interior surface which rotates with respect to the outer surface, similar to the rotating bearings described above with respect to the drilling tool 110 of FIG. 1. For example, one or more bearings 216*a*, 216*b* can have an interior surface in contact with a sleeve (not shown) encasing the rotating shaft 212 and positioned between the bearings 216*a*, 216*b* and an exterior surface in contact with the inner surface of the housing 214. In certain embodiments, the bearings 216*a*, 216*b* comprise roller bearings, although other types of bearings or other mechanisms can be used which are capable of transferring the load between the rotating shaft 212 and the nominally non-rotating housing 214.

In certain embodiments, the first portion 218 is between the first end 220 and about one-quarter of the length of the shaft 212 from the first end 220 towards the second end 224. In another embodiment, the first portion 218 is between the first end 220 and about 10 percent of the length of the shaft 212 towards the second end 224. In various other configurations, the first portion 218 is between the first end 220 and some distance less than 10 percent of the length of the shaft 212, some distance between 10 percent and one-third of the length of the shaft 212, or some distance greater than one-third of the length of the shaft 212 from the first end 220 towards the second end 224.

Additionally, the location at which the bending moment is exerted to the shaft by the steering subsystem 226 can be between the first end 220 and about one-quarter of the length of the shaft 212 from the first end 220 towards the second end 224. In another embodiment, the location at which the bending moment is exerted to the shaft 212 by the steering subsystem 228 is between the first end 220 and about 10 percent of the length of the shaft 212 towards the second end 224. In various other configurations, the location at which the bending moment is exerted to the shaft by the steering subsystem 226 is between the first end 220 and some distance less than 10 percent of the length of the shaft 212, some distance between 10 percent and one-third of the length of the shaft 212, or some distance greater than one-third of the length of the shaft 212 from the first end 220 towards the second end 224.

Generally, the first portion 218 (and thus the steering subsystem 228 which is operatively coupled to the first portion 218) can be positioned so as to provide enhanced steering efficiency. For example, the first portion 218 is oriented relatively near the drill bit structure 226. Thus, the steering subsystem 228 applies steering force relatively near the drill bit structure 226, resulting in a corresponding shaft angulation. Because angulation in a portion of the shaft 212 near the drill bit structure 226 (e.g., in the first portion 218) can generally translate directly into directional changes in the borehole during drilling, this configuration results in improved steering efficiency. In certain embodiments, substantially all of the steering forces applied to the shaft 212 by the steering subsystem 228 are applied to the first portion 218.

The steering subsystem 228 further comprises an actuation assembly 232 mechanically coupled to the pair of bearings 230 in certain embodiments. In certain embodiments, the pair of bearings 230 may be referred to as an angulation assembly or may form a part of an angulation assembly. The actuation assembly 232 can be configured to apply forces through the pair of bearings 230 to deflect the shaft 212 in a predetermined plane. For example, the actuation assembly 232 of certain embodiments deflects the shaft 212 so as to steer the drilling tool 210 in a desired direction. The actuation assembly 232 comprises a hydraulic actuation system in some embodiments, for example, and can include actuators 234 operatively coupled to the pair of bearings 230. The actuators 234 may comprise pressurized, hydraulic actuators, for example. While other configurations are possible, in one embodiment, there are four actuators 234 disposed around a cantilever 236 which in turn is disposed around the circumference of the shaft 212. In certain embodiments, the cantilever 236 mechanically couple the actuation assembly 232 and the pair of bearings 230. The actuators 234 of certain embodiments are hydraulically expandable against the housing 210 so as to apply a force to the pair of bearings 230 via the cantilever portions 236. In other embodiments, some other type of actuation assembly 232 is used, instead of, or in addition to a hydraulic actuation assembly.

The steerable drilling tool 210 can include an anti-rotation device 239. For example, in the illustrated embodiment of FIG. 5, the anti-rotation device 239 includes a plurality of spring box structures disposed about the housing 214. The anti-rotation device 239 generally contacts the interior portion of the wellbore 252 during use, preventing significant rotation of certain non-rotating portions of the tool 210 (e.g., the housing 214). In one embodiment, the spring box structures comprise ARD Spring Boxes having carbide inserts. Other types of anti-rotation devices 239 may be used, such as the anti-rotation devices 139 of the steerable drilling tool 110 of FIG. 1.

The steerable drilling tool 210 can include one or more stabilizers. For example, a first stabilizer 227*a* operatively couples the drill bit structure 226 to the first portion 218. In addition, a second stabilizer 227*b* operatively couples the second portion 222 to one or more pipe segments 229. One or more of the first and second stabilizers 227*a*, 227*b* of certain embodiments have a diameter slightly smaller than or approximately equal to the diameter of the drill bit structure 226, but wider than the housing 214 and other components of the steerable drilling tool 210. Thus, the stabilizers 227*a*, 227*b* generally define the lateral position of the steerable drilling tool 210 in the borehole 252, preventing significant lateral, non-axial movement of the steerable drilling tool 210 with respect to the borehole 252. The stabilizers 227*a*, 227*b* may additionally be configured to rotate during drilling. Additionally, hollowed regions (not shown) extending axially along the length of the stabilizers 227*a*, 227*b* can be adapted to transmit drilling fluid. In certain embodiments, the stabilizers 227*a*, 227*b* can aide in borehole cleaning and can prevent lodging of the drilling tool 210 during use.

Figure 7:
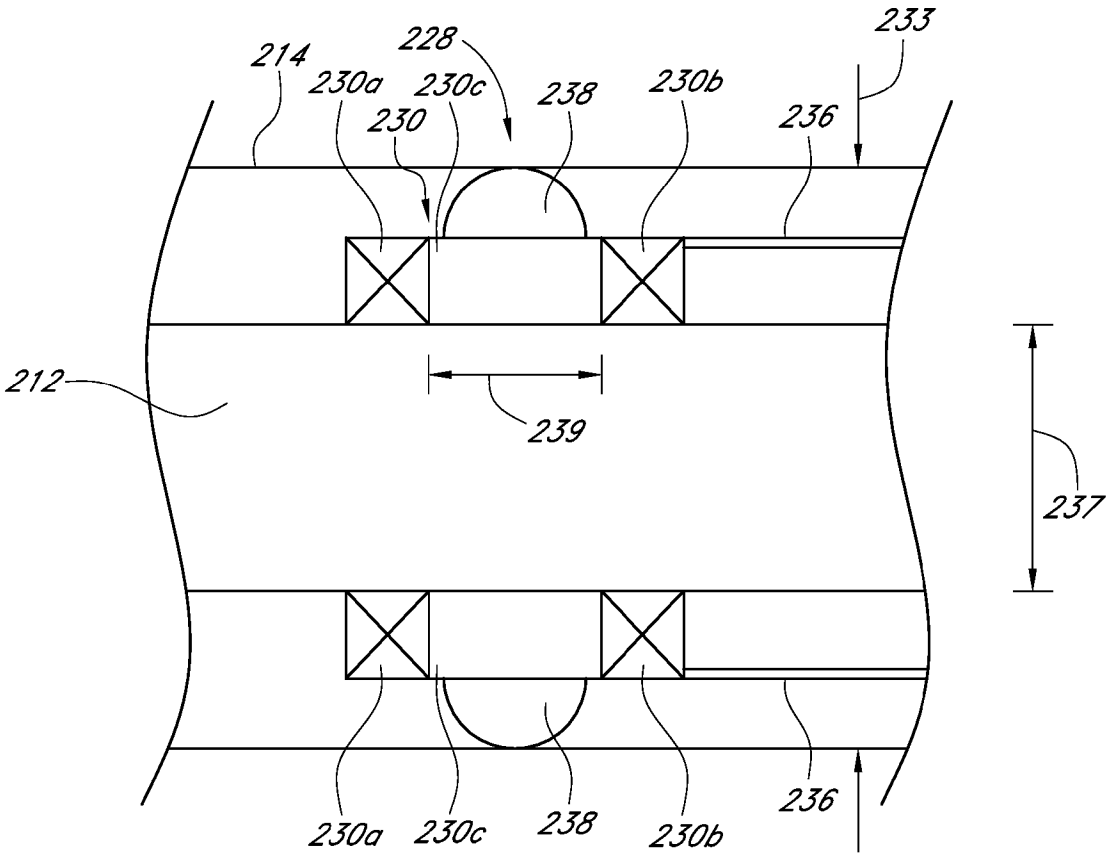
FIG. 7 is a partial cut-away schematic diagram illustrating portions of a steering subsystem of the drilling tool of FIG. 5.

FIG. 7 is a partial cut-away schematic diagram showing a close-up view of portions of the steering subsystem 228 of the drilling tool 210 of FIG. 5. As shown in FIG. 7, in certain embodiments, the at least one bearing 230 can comprise a first bearing 230*a* and a second bearing 230*b* contained in a housing 230*c*. In some embodiments, the bearings 230*a*, 230*b* are needle roller bearings (e.g., a combination of needle bearings and roller bearings), and are used to locate and maintain the position of the bearing assembly.

The pair of bearings 230*a*, 230*b* in certain embodiments is configured to pivot about an axis generally perpendicular to the shaft 212 during angulation. For example, in one embodiment, the pair of bearings 230*a*, 230*b* is configured to pivot about the axis when one or more of the actuators 234 are expanded. As shown in FIG. 7, in certain embodiments, the steering subsystem 228 is disposed within the housing 214 and the steering subsystem 228 can further comprise a pivot member 238 disposed generally between the housing 214 and the pair of bearings 230*a*, 230*b*. During angulation, the pair of bearings 230*a*, 230*b* can be configured to pivot about the pivot member 238. In certain embodiments, the pivot member 238 is positioned approximately midway between the two bearings of the pair of bearings 230. In other embodiments, the pivot member 238 can be positioned nearer the first bearing or nearer the second bearing of the pair of bearings 230. The pivot member 238 comprises a non-rotating spherical bearing in certain embodiments.

As shown in FIG. 7, the pair of bearings 230 of certain embodiments can comprise two bearings 230*a*, 230*b* spaced apart from one another longitudinally with respect to the shaft 212. The spacing between the bearings 230 can be selected so as to provide improved steering control and/or efficiency. For example, in certain embodiments, the two bearings 230*a*, 230*b* of the pair of bearings 230 are spaced apart from one another by a distance 239 in a range between about four times the diameter 237 of the rotating shaft 212 to about eight times the diameter of the rotating shaft 212. In other embodiments, the two bearings 230*a*, 230*b* of the pair of bearings 230 are spaced apart from one another by from about the diameter 237 of the shaft 212 to about four times the diameter 237 of the shaft.

In one embodiment, for example, the diameter 233 of the tool is about 4¾ inches, the diameter 237 of the shaft 212 is about 60 millimeters (i.e., about 2.4 inches), and the pair of bearings 230*a*, 230*b* are spaced apart from one another by a distance 239 of about 12 inches. In another embodiment, for example, the diameter 233 of the tool is about 4¾ inches, the diameter 237 of the shaft 212 is about 60 millimeters (i.e., about 2.4 inches), and the pair of bearings 230*a*, 230*b* are spaced apart from one another by a distance 239 of about 10 inches. In another configuration, the diameter 233 of the tool 210 is about 10 inches, the diameter 237 of the shaft 212 is about 125 mm (i.e., about 5 inches), and the pair of bearings 230*a*, 230*b* are spaced apart from one another by a distance of about 20 inches. In other embodiments, the two bearings 230*a*, 230*b* are spaced apart by some other distance 239, such as a distance 239 less than about the diameter 237 of the shaft 212 or greater than about 4 times the diameter 237 of the shaft 212. In yet another embodiment, the diameter of the tool 210 is about 10 inches, the diameter 237 of the shaft 212 is about 200 mm (i.e., about 7.9 inches), and the pair of bearings 230*a*, 230*b* are spaced apart from one another by a distance of about 20 inches. In other embodiments, the two bearings 230*a*, 230*b* are spaced apart by some other distance 239, such as a distance 239 less than about four times the diameter 237 of the shaft 212 or greater than about eight times the diameter 237 of the shaft 212. In further instances, the two bearings 230*a*, 230*b* are spaced apart by some other distance 239, such as a distance 239 less than about the diameter 237 of the shaft 212 or greater than about 4 times the diameter 237 of the shaft 212.

The first and second bearings 230*a*, 230*b* of the pair of bearings 230 each comprise one or more needle bearings in certain embodiments, although other types of bearings or other devices can be used, such as, for example, one or more other types of roller bearing. Generally, the pair of bearings 230 can include any type of bearing or other device capable of transferring load between the rotating shaft 212 and the actuation assembly 232. Additionally, in some embodiments, the pair of bearings 230 are configured to transmit relatively high loads. In some configurations, for example, each bearing can transmit up to about five tons of load during steering.

In certain embodiments, other types of angulation assemblies, such as those not comprising a pair of bearings 230 may be used. For example, the angulation assembly can comprise more than two bearings, or can comprise a single bearing. As shown in FIG. 7, the angulation assembly 232 (e.g., comprising or operatively coupled to the pair of bearings 230) can be operatively coupled to the first portion 218 and to the shaft 212. In certain embodiments, the pivot member 238 is mechanically coupled to the angulation assembly 232 and the angulation assembly 232 is configured to pivot in a plane substantially parallel to the shaft 212 about the pivot member 238, such as through actuation of one or more of the actuators 234.

Figure 8:
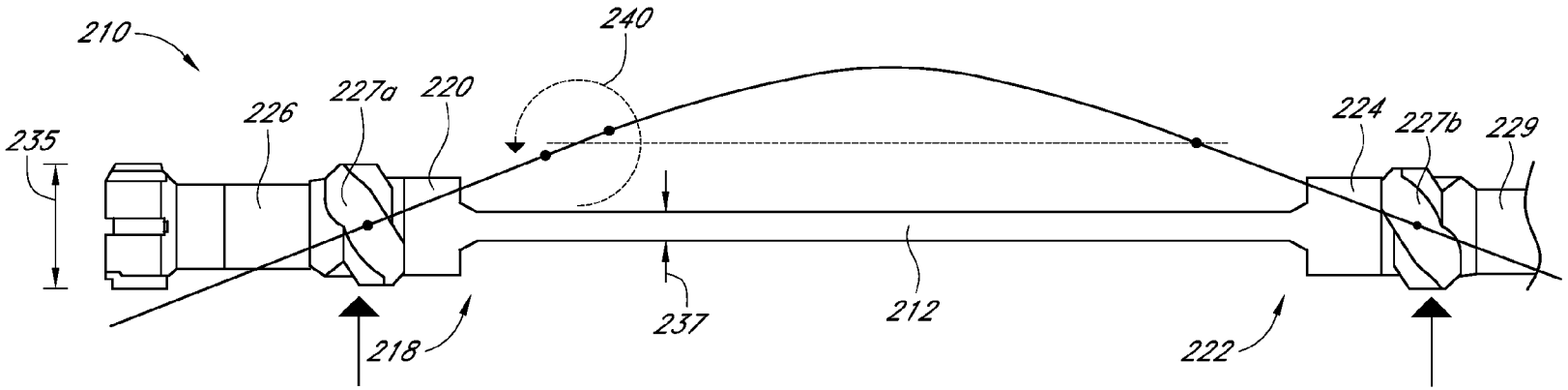
FIG. 8 is a cut-away schematic diagram illustrating certain forces incident on portions of the steerable drilling tool of FIG. 5 during an example steering operation.

FIG. 8 schematically illustrates forces incident on portions of a steerable drilling tool such as the tool 210 of FIG. 5 during an example steering operation, in accordance with certain embodiments described herein. For the purposes of illustration, only certain portions of the steerable tool 210 are shown in FIG. 8. Referring to FIGS. 5, 6, and 8, and according to one example steering scenario, one or more of the actuators 234 or portions thereof may be expanded so as to exert forces on the pair of bearings 230*a*, 230*b* via the one or more cantilevers 236. The pair of bearings 230*a*, 230*b* are responsive to the forces from the actuators 234 to exert corresponding forces on the shaft 212, resulting in an actuation, or bending moment 240. In turn, the bending moment 240 causes a change in the shaft 212 angulation, and a corresponding change in the drilling direction during use. In general, a desired magnitude and direction of the bending moment 240 can be achieved through actuation of the actuators 234, resulting in a corresponding magnitude and direction of the shaft 212 angulation and change in the drilling direction.

For the purposes of illustration, the bending moment 240 is shown in FIG. 8 as being applied in a counterclockwise direction. Such a bending moment 240 results in a change in the shaft angulation and corresponding change in the drilling direction in the direction 242 (e.g., downward with respect to FIG. 5). In the illustrated embodiment of FIG. 8, a counterclockwise bending moment 240 can be generated through actuation of one or more of the actuators 234 or portions thereof which are operatively coupled to a portion of the rotating shaft 212. For example, one or more actuators 234*a* are expanded, and a force is applied between the cantilever 236 and the housing 214. As another example, a clockwise bending moment 240 will result in a change in shaft angulation and corresponding change in drilling direction in the direction 244 (e.g., upward with respect to FIG. 5). A clockwise bending moment 240 may be generated by actuating one or more of the actuators 234*b* or portions thereof, for example. Similarly, the tool 210 may be steered in a rightward direction (e.g., wherein the drill bit structure 226 angulates generally into the page with respect to FIG. 5) through actuation of one or more actuators 234 or portions thereof on the left side of the shaft 212, or in a leftward direction (e.g., wherein the drill bit structure 226 angulates generally out of the page with respect to FIG. 5) through actuation of one or more actuators 234 or portions thereof on the right side of the shaft 212. As will be appreciated, selective actuation of the one or more actuators 234 can be used to steer the tool in generally any direction. Moreover, a variety of other types of actuators 234 and configurations of the actuators 234 are possible. Moreover, by generating the bending moment 240 relatively near the drill bit, such techniques provide steering functionality in a relatively efficient manner as compared to techniques in which the bending forces are exerted further from the drill bit.

The steering can further be applied with knowledge of subtwist, i.e., the rotational orientation of the nominally non-rotating portions of the steerable drilling tool 210 (e.g., the housing 214), which can be measured as an angle from the high side of the tool 210. The subtwist can be derived from a directional sensor included on the tool, for example, and the subtwist measurement can be derived from two axes of acceleration measurements provided by the directional sensor. Subtwist can be used to determine which electro-hydraulic valves to actuate in order to bend the shaft 212 in the appropriate manner so as to steer the tool in the desired direction.

Figure 9:
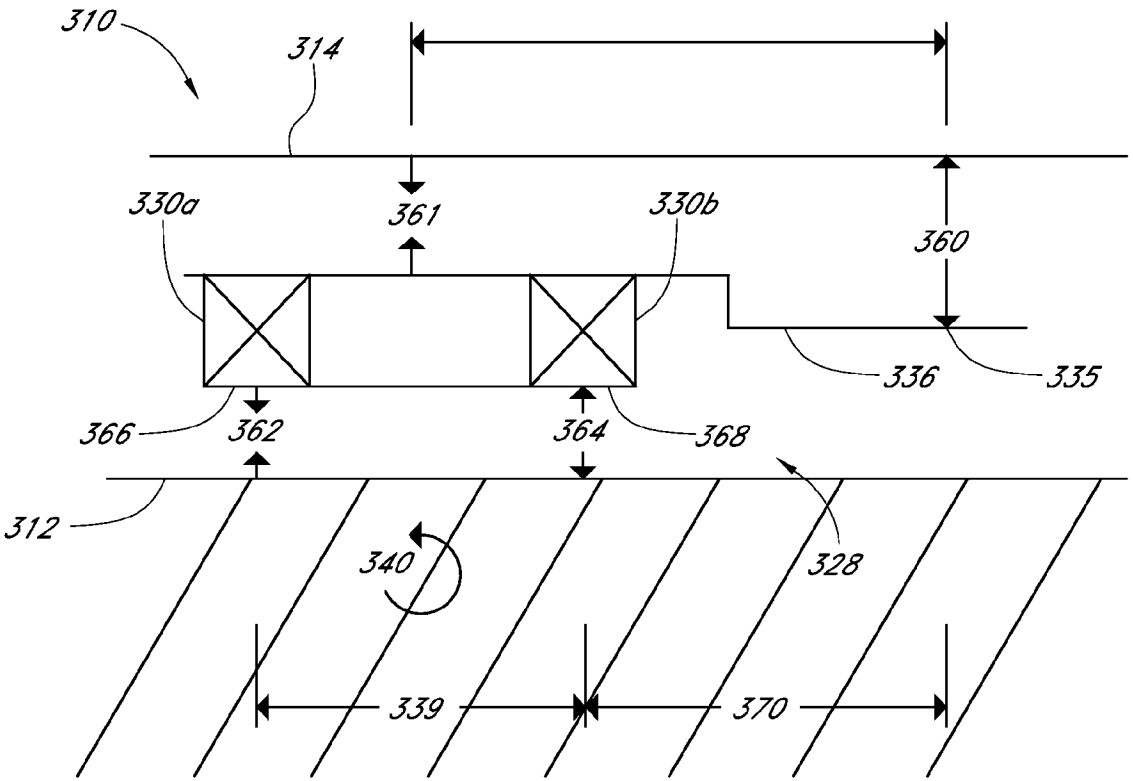
FIG. 9 shows a force diagram illustrating certain forces incident on portions of an example steerable drilling tool during a steering operation, in accordance with certain embodiments described herein.

FIG. 9 shows a force diagram illustrating certain forces incident on portions of a steerable drilling tool 310 during a steering operation, in accordance with certain embodiments described herein. The drilling tool 310 includes a housing 314, a pair of bearings including first and second bearings 330*a*, 330*b* and which is coupled to a cantilever 336 and a shaft 312. FIG. 9 also shows arrows representing a variety of forces 360, 361, 362, 364 that are incident on respective portions of the tool 310 during steering operations. Each of the forces 360, 361, 362, 364 are represented by two arrowheads, representing the action/reaction pairs. The force diagram of FIG. 9 may correspond to forces associated with a steering operation performed by the steering subsystem 228 of the tool 210 of FIGS. 5 through 8, for example. A force 360 is applied between the cantilever 336 and the housing 314. For example, the force 360 can be applied via selective application of the one or more actuators (not shown) as described above. The force 360 is reacted at the pivot member (e.g., a spherical bearing, not shown), as illustrated by the reaction force 361. The resulting bending moment 340 is generated, which is applied to the rotating shaft 312 (e.g., through a pair of bearings 330*a*, 330*b*). Although the pair of bearings 330*a*, 330*b* are shown spaced from the shaft 312 in FIG. 9 for the purposes of illustration, the pair of bearings 330*a*, 330*b* are directly or indirectly mechanically coupled to the shaft 312, as shown in FIGS. 5 and 7, for example.

In certain embodiments, the steering subsystem 328 is configured to angulate the shaft 312 by exerting first and second forces 362, 364 on the shaft 312 at first and second locations 366, 368 on the shaft 312 which are spaced apart from one another by a distance 339. For example, the first and second locations 366, 368 may correspond to the locations of the first and second bearings 330*a*, 330*b* of the pair of bearings. In certain embodiments, the two locations 366, 368 are spaced apart from one another by a distance 339 in a range between about four times the diameter (not shown) of the rotating shaft 312 to about eight times the diameter of the rotating shaft 312. In certain other embodiments, the two locations 366, 368 are spaced apart from one another by a distance 339 in a range between about the diameter (not shown) of the rotating shaft 312 to about four times the diameter of the rotating shaft 312 Generally, the distance 339 can be selected such that the bending moment 340 generated by the steering subsystem 328 is capable of deflecting the shaft 312 sufficiently, enabling the desired steering magnitude and turn rate.

In one embodiment, for example, the diameter of the tool (not shown) is about 4¾ inches, the diameter of the shaft 312 is about 62 millimeters (i.e., about 2.4 inches), and the first and second locations 366, 368 are spaced apart from one another by a distance 339 of about 12 inches. In another instance, the diameter of the tool (not shown) is about 4¾ inches, the diameter of the shaft 312 is about 60 millimeters (i.e., about 2.4 inches), and the first and second locations 366, 368 are spaced apart from one another by a distance 339 of about 10 inches. In another embodiment, the diameter of the tool (not shown) is about 10 inches, the diameter of the shaft 312 is about 125 mm (i.e., about 5 inches), and the first and second locations 366, 368 are spaced apart from one another by a distance 339 of about 20 inches. In yet another embodiment, the diameter of the tool (not shown) is about 10 inches, the diameter of the shaft 312 is about 200 mm (i.e., about 7.9 inches), and the first and second locations 366, 368 are spaced apart from one another by a distance 339 of about 20 inches. In other embodiments, the first and second locations 366, 368 are spaced apart by some other distance, such as a distance less than about the diameter of the shaft 312, less than about four times the diameter of the shaft, greater than about four times the diameter of the shaft 212, or greater than about eight times the diameter of the shaft. Additionally, as shown, the first and second forces 362, 364 of certain embodiments are exerted substantially perpendicular to the shaft 312 and in substantially opposite directions.

In certain embodiments, the bending moment (M) 340 may be expressed as $M=F(a+b/2)$, where F is the force 360, a is the distance 370 between the location 335 on the cantilever 336 where the actuation force 360 is applied and the second location 368, and where b is the distance between the first location 366 and the second location 368. In certain embodiments, the bending moment (M) 340 can also be represented as $M=FA*b=FB*b$, where FA=FB, FA is the force 364, and FB is the force 362.

Referring again to FIG. 6, the drilling tool 210 can additionally include one or more directional sensors 262 in certain embodiments. For example, although other types of sensors may be used, the one or more directional sensors 262 can comprise one or more gyroscopes in certain embodiments. For example, at least one gyroscopic sensor can be used which is configured to provide a data signal indicative of the orientation of the steerable drilling tool 210 relative to the rotation axis of the Earth. In certain such embodiments, the gyroscopic sensor is a rate gyroscope comprising a spinning gyroscope, typically with the spin axis substantially parallel to the borehole 252. The spinning gyroscope undergoes precession as a consequence of the Earth's rotation. The rate gyroscope is configured to detect the components of this precession and to generate a corresponding data signal indicative of the orientation of the rate gyroscopes' spin axis relative to the Earth's axis of rotation. By measuring this orientation relative to the Earth's axis of rotation, the rate gyroscope can determine the orientation of the steerable drilling tool 210 relative to true north. Such rate gyroscopes can be used in either a gyrocompass mode while the steerable drilling tool 210 is relatively stationary, or a gyrosteering mode while drilling is progressing. Exemplary gyroscopic sensors compatible with embodiments described herein are described more fully in "Survey Accuracy is Improved by a New, Small OD Gyro," G. W. Uttecht, J. P. deWardt, World Oil, March 1983; U.S. Pat. Nos. 5,657,547, 5,821,414, and 5,806,195. These references are incorporated in their entireties by reference herein. Other examples of gyroscopic sensors are described by U.S. Pat. Nos. 6,347,282, 6,957,580, 7,117,605, 7,225,550, 7,234,539, 7,350,410, and 7,669,656 each of which is incorporated in its entirety by reference herein.

The directional sensors 262 may also include accelerometers such as those currently used in conventional borehole survey tools. The one or more directional sensors 262 in some embodiments comprise one or more cross-axial accelerometers used to provide measurements for the determination of the inclination, the high-side tool face angle, or both. For example, the accelerometers can be configured to sense the components of the gravity vector. In certain embodiments, two or more single-axis accelerometers are used, while in other embodiments, one or more two-axis or three-axis accelerometers are used. The data signals produced by such an accelerometer are indicative of the orientation of the accelerometer relative to the direction of Earth's gravity (i.e., the inclination of the accelerometer from the vertical direction). In order to provide an improved determination of the trajectory and position of the downhole portion 254 of the drill string 250, certain embodiments described herein may be used in combination with a system capable of determining the depth, velocity, or both, of the downhole portion 254. Examples of such systems are described in U.S. Pat. No. 7,350,410, entitled "System and Method for Measurements of Depth and Velocity of Instrumentation Within a Wellbore," and U.S. Patent Application Publication No. U.S. 2009/0084546, entitled "System and Method for Measuring Depth and Velocity of Instrumentation Within a Wellbore Using a Bendable Tool," each of which is incorporated in its entirety by reference herein.

In still other embodiments, the one or more directional sensors 262 comprise one or more magnetometers configured to sense the magnitude and direction of the Earth's magnetic field. The data signals produced by such magnetometers are indicative of the orientation of the magnetometer relative to the Earth's magnetic field (i.e., azimuth relative to magnetic north). An exemplary magnetometer compatible with embodiments described herein is available from General Electric Company of Schenectady, N.Y.

The one or more directional sensors 262 can also be located on another portion of the drill string 254, such as on a section of drill pipe 229 above the steerable drilling tool 210. In certain embodiments, the directional sensors 262 form part of an instrumentation pack, such as a measurement-while-drilling (MWD) or logging-while-drilling (LWD) instrumentation pack.

The drill string 250 in some embodiments includes a controller 258 generally configured to control and/or monitor the operation of the drill string 250 or portions thereof. The controller 258 can be configured to perform a variety of functions. For example, the controller 258 can be adapted to determine the current orientation or the trajectory of the drilling tool 210 within the borehole 252. The controller 258 can further comprise a memory subsystem adapted to store appropriate information, such as orientation data, data obtained from one or more sensors located on the drill string 250, etc. The controller 258 can comprise hardware, software, or a combination of both hardware and software. For example, the controller 258 can comprise one or more microprocessors, or a standard personal computer.

In certain other embodiments, the controller 258 provides a real-time processing analysis of the signals or data obtained from various sensors within the downhole portion 254. In certain such real-time processing embodiments, data obtained from the various sensors of the downhole portion 254 are analyzed while the downhole portion 254 travels within the borehole 252. In certain embodiments, at least a portion of the data obtained from the various sensors is saved in memory for analysis by the controller 258. The controller 258 of certain such embodiments comprises sufficient data processing and data storage capacity to perform the real-time analysis.

The steering subsystem 228 can be configured, as drilling proceeds, to angulate the shaft 212 so as to change a current borehole course, or to maintain the current borehole course. The current borehole course can be defined in terms of an inclination and an azimuth of the borehole. In certain embodiments, the steering subsystem 228 is configured to change or maintain the current borehole course in accordance with a preprogrammed course or directional commands. For example, in some embodiments, an operator may input a preprogrammed course into a terminal, such as a computer terminal located above ground (e.g., a terminal coupled to the controller 258 or to the on-board computing system 260), prior to deployment of the steerable tool 210. In other embodiments, the operator can input directional commands into the terminal during drilling. In some cases, a combination of a preprogrammed course and real-time directional commands can be used to steer the tool 210.

The drill string 250 can include one or more additional controllers instead of, or in addition to, the controller 258. For example, in certain embodiments, the controller 258 is located at or above the Earth's surface, and one or more additional controllers are located within the downhole portion 254 of the drill string 250. In some embodiments, the drilling tool 210 includes an on-board computing system 260, although in other configurations the computing system may not be located on the tool 210. Where the controller 258 is located at or above the Earth's surface, it may be communicatively coupled to the on-board computing system 260. In certain embodiments, the downhole portion 254 is part of a borehole drilling system capable of measurement while drilling (MWD) or logging while drilling (LWD). In such embodiments, signals from the downhole portion 254 are transmitted by mud pulse telemetry or electromagnetic (EM) telemetry. In certain embodiments where at least a portion of the controller 258 is located at or above the Earth's surface, the controller 258 is coupled to the downhole portion 254 (e.g., to the on-board computing system 260, to the sensors located within the downhole portion 254, etc.) within the borehole 252 by a wire or cable extending along the drill string 250. In certain such embodiments, the drill string 250 may comprise signal conduits through which signals are transmitted from the downhole portion 254 (e.g., from the on-board computing system 260 or from sensors located within the downhole portion 254) to the controller 258. In certain embodiments in which the controller 258 is adapted to generate control signals for the various components of the downhole portion 254, the drill string 250 is adapted to transmit the control signals from the controller 258 to the downhole portion 254.

The computing system 260 of certain embodiments can store information related to the drilling tool 210, operation of the drilling tool 210, and the like. For example, the computing system 260 can store information related to the target drilling course, current drilling course, tool configuration, tool componentry, and the like. The on-board computing system 260 and/or one or more directional sensors 262 can be within a nominally non-rotating section of the drilling tool 210 (e.g., within the housing 210). In other embodiments, the computing system 260 and/or one or more directional sensors 262 can be located elsewhere, such as within a rotating section of the tool 210, or at some other location within the borehole 252

(e.g., on some other portion of the drill string 250). In some embodiments, a measurement-while-drilling (MWD) (not shown) instrumentation pack including one or more directional sensors 262 is mounted on the downhole portion 254 of the drill string 250 at some location above the drilling tool 210.

Figure 10:
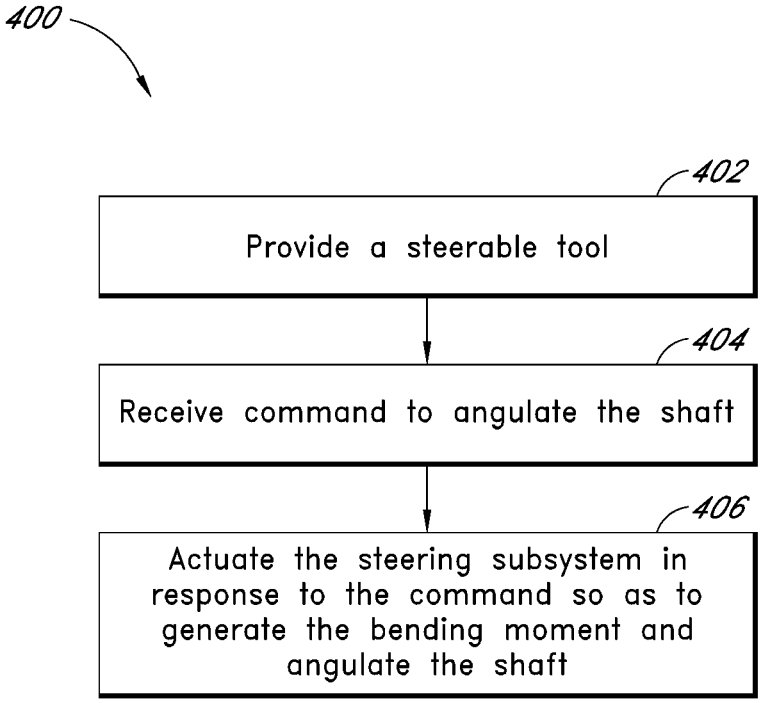
FIG. 10 is a flow diagram illustrating an example method for steering a drilling tool while drilling a borehole in accordance with certain embodiments described herein.

FIG. 10 is a flow diagram illustrating an example method 400 for steering a drilling tool 210 while drilling a borehole in accordance with certain embodiments described herein. While the method 400 is described herein by reference to certain embodiments of the tool 210 described with respect to FIGS. 5 through 8, other tools, such as any of the other tools described herein may be used with the method 400.

According to certain embodiments, the method 400 includes providing a steerable drilling tool 210 at operational block 402. The tool 210 of certain embodiments includes a rotatable shaft 212 having a first portion 218 terminating at a first end 220 of the shaft 212 and a second portion 222 terminating at a second end 224 of the shaft 212. The tool 210 can further include a drill bit structure 226 operatively coupled to the first portion 218. In certain embodiments, the tool 210 includes a steering subsystem 228 configured to angulate the shaft by exerting bending moment substantially entirely on the first portion 218. In certain embodiments, the first portion 218 is between the first end 220 and one-third of the length of the shaft 212 from the first end 220 towards the second end 224. In certain other embodiments, the first portion 218 is between the first end 220 and 20 percent of the length of the shaft 212 from the first end 220 towards the second end 224. In yet other embodiments, the first portion 218 is between the first end 220 and 10 percent of the length of the shaft 212 from the first end 220 towards the second end 224.

At operational block 404, the method 400 can further include receiving a command to angulate the shaft 212 so as to direct the drilling tool 210 from a current course to a target course. For example, the command can be issued or initiated by a user, by the computing system 260, by the directional sensors 262, combinations of the same or the like. The current course of certain embodiments comprises the current inclination and azimuth of the borehole. The target course can be a target inclination and azimuth of the borehole. The method 400 can also include receiving a signal from one or more directional sensors 262 of the drilling tool 210 indicative of the current course of the drilling tool 210. The current course, the target course, or both, can be stored within the computing system 260. In other embodiments, such information may be stored at some other appropriate location (e.g., in one or more memory devices coupled to the controller 258 or otherwise coupled to the drilling tool 210).

In certain other embodiments, one or more gamma sensors are be used to determine the current course. For example, the drilling tool 210 may include gamma sensors instead of or in addition to the directional reference sensors 262. Accordingly, in such cases gamma intensity measured from the sensors can be used in steering instead of inclination or other measurements taken from the directional reference sensors 262. The gamma sensors can be used to provide a closed-loop steering system, e.g., where steering decisions are made automatically by the computer system 260 using the gamma measurements and without user input, for example. In one configuration, the drilling tool 210 is advantageously configured to switch between using the directional reference sensors 262 and using the gamma sensors to determine the current course. For example, steering using the gamma sensors may be particularly useful when it is desirable to steer the tool 210 in relation to geological formations, such as along a geological boundary. On the other hand, steering using the directional reference sensors 262 is well-suited to steering the tool geometrically. As such, according to certain configurations, the system allows the user to select which type of steering to use based on the particular situation.

In certain embodiments, the current course corresponds to a current borehole course, and the target corresponds to a target or desired borehole course. In such embodiments, differences between the current borehole course and the target or desired borehole course can be used to adjust the angulation of the shaft 212, thereby adjusting the amount of borehole curvature as the drill string 250 progresses during drilling. Example drill strings 250 capable of performing such tracking and adjustment of borehole curvature are described in U.S. patent application Ser. No. 12/607,927 Application, filed on Oct. 28, 2009, entitled "Downhole Surveying Utilizing Multiple Measurements," ("the '927 Application") which is incorporated in its entirety by reference herein. In such embodiments, the drill string 250 can include first and second sensor packages mounted at first and second portions of the drill string 250, and a controller capable of calculating a bend between the first portion and the second portion. Examples of such drill strings and associated methods are described with respect to FIGS. 9 through 12 and paragraphs [0111] through [0138] of the '927 Application, and are incorporated by reference herein.

In general, steering (e.g., deflection of the shaft) is applied in the plane of the current course and target course vectors. In some embodiments, the on-board computing system 260 calculates orientation information on a periodic basis and determines whether a steering adjustment is appropriate. For example, in one embodiment, the computing system 260 calculates tool-face angle using measurements from the directional sensors 262 about every 1 minute, although other orientation measurements and update periods may be used.

In certain embodiments, the method 400 includes actuating the steering subsystem 228 in response to the command at operational block 406 so as to generate the bending moment 240 and to angulate the shaft 212. For example, the command may be received by the computing system 260, which may in turn generate and transmit a command to one or more of the actuators 234 (e.g., hydraulic actuators) to actuate, causing the steering subsystem 228 to angulate the shaft as discussed herein. In certain cases, the command can be input by drilling personnel into an above-ground computing system coupled to the drilling tool 210 such as the controller 258 described above with respect to FIG. 6. Additionally, or alternatively, in certain embodiments, the computing system 260 provides automatic steering, such as automatic steering in response to signals received from the one or more directional sensors 262. The processing involved with the automatic steering may be implemented above ground (e.g., at the above-ground controller 258), on the computing system 260, or by some other computing system.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Depending on the embodiment, certain acts, events, or functions of any of the methods described herein can be performed in a different sequence, can be added, merged, or left out all together (e.g., not all described acts or events are necessary for the practice of the method). Moreover, in certain embodiments, acts or events can be performed concurrently, e.g., through multi-threaded processing, interrupt processing, or multiple processors or processor cores, rather than sequentially.

The various illustrative logical blocks, modules, circuits, and algorithm steps described in connection with the embodiments disclosed herein can be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks, modules, and circuits described in connection with the embodiments disclosed herein can be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be any conventional processor, controller, microcontroller, or state machine. A processor can also be implemented as a combination of computing devices, e.g., a combination of a DSP and a microprocessor, a plurality of microprocessors, one or more microprocessors in conjunction with a DSP core, or any other such configuration.

The blocks of the methods and algorithms described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, a hard disk, a removable disk, a CD-ROM, or any other form of computer-readable storage medium known in the art. An exemplary tangible, computer-readable storage medium is coupled to a processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. A steerable drilling tool comprising:

a rotatable shaft extending through a housing where the shaft and the housing are separated by at least one bearing, the shaft having a first portion terminating at a first end of the shaft and a second portion terminating at a second end of the shaft;

a drill bit structure operatively coupled to the first portion; and a steering subsystem comprising a pair of bearings operatively coupled to the first portion, the steering subsystem configured to angulate the shaft by exerting force substantially through the pair of bearings, the first portion between the first end and about one-third of the length of the shaft from the first end towards the second end, the steering subsystem further comprising an actuation assembly mechanically coupled to the pair of bearings, the actuation assembly configured to apply forces through the pair of bearings to deflect the shaft in a predetermined plane.

2. The steerable drilling tool of claim 1, wherein the first portion is between the first end and about one-quarter of the length of the shaft from the first end towards the second end.

3. The steerable drilling tool of claim 1, wherein the first portion is between the first end and about 10 percent of the length of the shaft towards the second end.

4. The steerable drilling tool of claim 1, wherein the steering subsystem is configured, as drilling proceeds, to angulate the shaft so as to change a current borehole course, or to maintain the current borehole course, the current borehole course defined in terms of at least one of an inclination and an azimuth of the borehole.

5. The steerable drilling tool of claim 4, wherein the steering subsystem is configured to change or maintain the current borehole course in accordance with a preprogrammed course or directional commands.

6. The steerable drilling tool of claim 1, wherein the pair of bearings are configured to pivot about an axis perpendicular to the shaft during angulation.

7. The steerable drilling tool of claim 6, wherein the actuation assembly comprises a hydraulic actuation system.

8. The steerable drilling tool of claim 6, wherein the steering subsystem is disposed within the housing and the steering subsystem further comprises a pivot member, the pair of bearings pivoting about the pivot member during angulation.

9. The steerable drilling tool of claim 8, wherein the pair of bearings comprises two bearings spaced apart from one another longitudinally with respect to the shaft.

10. The steerable drilling tool of claim 9, wherein the pivot member is positioned approximately midway between the two bearings.

11. The steerable drilling tool of claim 10, wherein the pivot member comprises a spherical bearing.

12. The steerable drilling tool of claim 8, wherein the two bearings are spaced apart from one another by a distance of from between about the diameter of the rotating shaft to about eight times the diameter of the rotating shaft.

13. The steerable drilling tool of claim 12, wherein the two bearings are spaced apart from one another by a distance of from between about four times the diameter of the rotating shaft to about eight times the diameter of the rotating shaft.

14. The steerable drilling tool of claim 12, wherein the two bearings are spaced apart from one another by a distance of from between about the diameter of the rotating shaft to about four times the diameter of the rotating shaft.

15. The steerable drilling tool of claim 8, wherein the pivot member is disposed between the housing and the pair of bearings.

16. The steerable drilling tool of claim 1, the steering subsystem further comprising a cantilever mechanically coupling the actuation assembly and the pair of bearings.

17. A steerable drilling tool comprising:

a housing;

a rotating shaft having a first portion terminating at a first end of the shaft and a second portion terminating at a second end of the shaft;

a drill bit structure operatively coupled to the first portion; and a steering subsystem disposed between the housing and the shaft, the steering subsystem comprising:

an angulation assembly operatively coupled to the first portion and to the shaft; and a pivot member mechanically coupled to the angulation assembly, the angulation assembly configured to pivot in a plane substantially parallel to the shaft about the pivot member.

18. A method for steering a drilling tool while drilling a borehole, the method comprising:

providing a steerable drilling tool comprising:

a rotatable shaft having a first portion terminating at a first end of the shaft and a second portion terminating at a second end of the shaft;

a drill bit structure operatively coupled to the first portion; and a steering subsystem configured to angulate the shaft by exerting a bending moment substantially entirely on the first portion, the first portion between the first end and one-third of the length of the shaft from the first end towards the second end;

receiving a command to angulate the shaft so as to direct the drilling tool from a current course to a target course and actuating the steering subsystem in response to the command so as to exert the bending moment and angulate the shaft.

19. The method of claim 18, wherein the first portion is between the first end and 20 percent of the length of the shaft from the first end towards the second end.

20. The method of claim 19, wherein the first portion is between the first end and 10 percent of the length of the shaft from the first end towards the second end.

21. The method of claim 18, further comprising receiving a signal from a directional sensor of the drilling tool indicative of the current course of the drilling tool.

22. The method of claim 21, wherein the drilling tool further comprises an on board computing system and the directional sensor within a nominally non-rotating section of the drilling tool, the computing system configured to receive the command and the signal.

23. The method of claim 22, wherein the current course comprises the current inclination and azimuth of the borehole and the target course comprises a target inclination and azimuth of the borehole stored within the computing system.

24. A steerable drilling tool comprising:

a rotating shaft having a first portion terminating at a first end of the shaft and a second portion terminating at a second end of the shaft;

a drill bit structure operatively coupled to the first portion; and a steering subsystem configured to angulate the shaft by exerting first and second forces on the shaft at first and second locations on the shaft which are spaced apart from one another by a distance of from between about the diameter of the rotating shaft to about eight times the diameter of the rotating shaft, the first and second forces exerted substantially perpendicular to the shaft and in substantially opposite directions, the steering subsystem further comprising an actuation assembly mechanically coupled to a pair of bearings operatively coupled to the first portion, the actuation assembly configured to apply forces through the pair of bearings to deflect the shaft in a predetermined plane.

25. The steerable drilling tool of claim 24, wherein the two locations on the shaft are spaced apart from one another by a distance of from between about four times the diameter of the rotating shaft to about eight times the diameter of the rotating shaft.

26. The steerable drilling tool of claim 24, wherein the two locations on the shaft are spaced apart from one another by a distance of from between about the diameter of the rotating shaft to about four times the diameter of the rotating shaft.

* * * * *